US006025014A

United States Patent [19]

Stango

[11] Patent Number: 6,025,014

[45] Date of Patent: Feb. 15, 2000

[54] METHOD AND DEVICE FOR DEPOSITING A LAYER OF MATERIAL ON A SURFACE

[75] Inventor: Robert J. Stango, Richfield, Wis.

[73] Assignee: Marquette University, Milwaukee, Wis.

[21] Appl. No.: 09/131,848

[22] Filed: Aug. 7, 1998

Related U.S. Application Data

[62] Division of application No. 08/867,072, Jun. 2, 1997, Pat. No. 5,827,368.

[51] Int. Cl.[7] ..... B05D 1/28

[52] U.S. Cl. ..... 427/11; 427/429

[58] Field of Search ..... 427/11, 429, 367, 427/368; 118/76, 77

[56] References Cited

U.S. PATENT DOCUMENTS 4,741,918 5/1988 Nagy de Nagybaczon et al. ..... 427/11
4,959,241 9/1990 Thomas et al. ..... 427/11
4,987,000 1/1991 Koshiba et al. ..... 427/11
5,723,168 3/1998 Swain et al. ..... 427/11

*Primary Examiner*—Fred J. Parker
*Attorney, Agent, or Firm*—Jansson, Shupe, Bridge & Munger, Ltd.

[57] ABSTRACT

A method and a device for depositing a layer of material on a surface is provided. The device includes a rotatable hub having a plurality of fibers projecting therefrom. The fibers are constructed from the material to be deposited on the surface. As the hub is rotated, a portion of the fiber engages the surface and melted thereon. In order to vary the thickness of the layer and/or insure proper melting of the fiber, the angular velocity of the hub may be varied, or the hub and/or the surface may be moved along a corresponding axis perpendicular to the axis of rotation of the hub.

19 Claims, 2 Drawing Sheets

FIG. 1
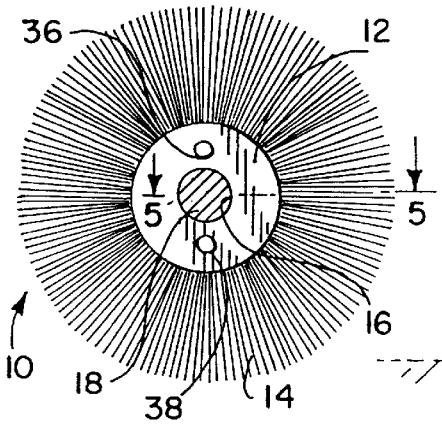
FIG. 2
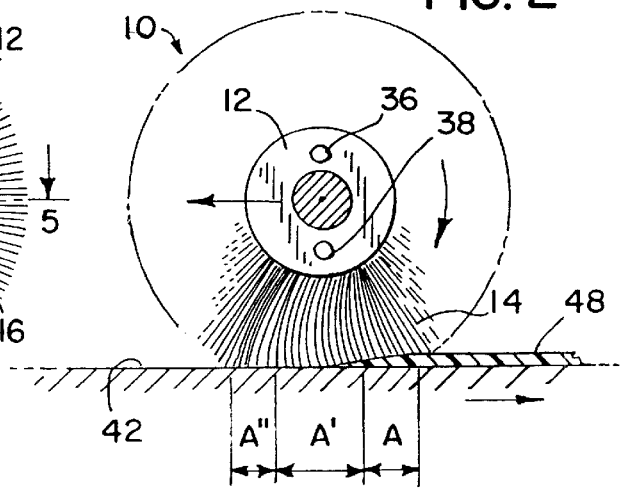
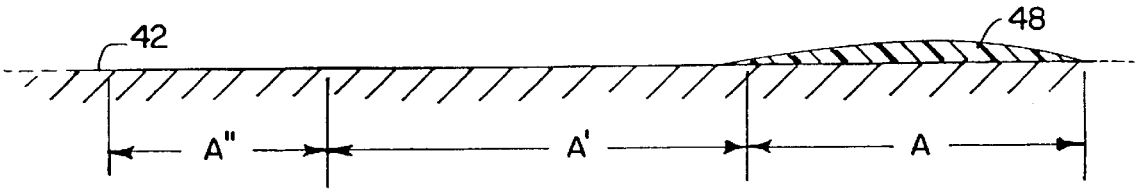
FIG. 3
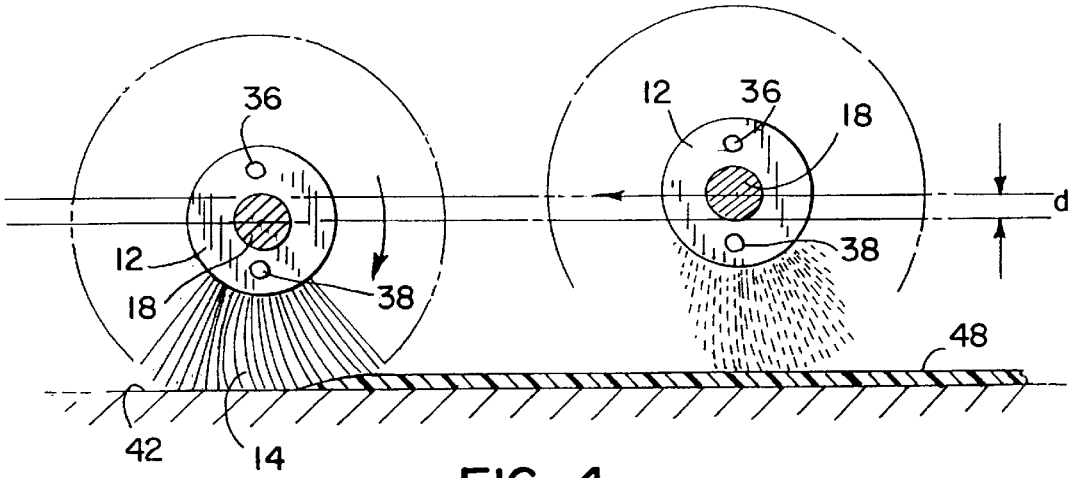
FIG. 4

METHOD AND DEVICE FOR DEPOSITING A LAYER OF MATERIAL ON A SURFACE

RELATED APPLICATION

This application is a division of application Ser. No. 08/867,072 filed on Jun. 2, 1997 now U.S. Pat. No. 5,827, 368.

BACKGROUND AND SUMMARY OF THE INVENTION

This invention relates to the coating of a surface, and in particular, to the depositing of a thin film of material onto a surface.

As is known, coatings are often applied to metallic, woods or plastic surfaces whenever there is a need for an improvement in the performance, function and/or aesthetic characteristics of the surface itself. For example, a coating such as a house paint may be placed on an external surface of a home in order to protect the external surface of the home from environmental exposure. Further, when reduced surface friction and wear resistance is required, materials such as polytetra Flouroethylene may be deposited on a surface of an article. For example, it is common for the food engaging surface of a frying pan to be coated with a polytetra Flouroethylene layer in order to prevent the food from sticking during cooking.

Heretofore, substances have been bonded or attached to surfaces in a plurality of procedures including painting, plating anodizing, and the like. Although the materials, equipment and bonding mechanisms differ depending on the coating process, all follow similar procedures. First, the surface is prepared in some manner for the coating. Thereafter, the material is deposited on the surface. After a predetermined time period for drying and/or curing of the deposited coating, touching up the coating is often required. Finally, the equipment must be cleaned and the waste materials must be disposed. As described, the various processes for applying the coating to a surface are time consuming and, quite possibly expensive.

The selection of a coating process and of the materials to be used is determined utilizing a cost benefit analysis associated with the above-described steps. Consequently, a coating process is not only measured by performance, but also by the costs associated therewith and the environmental impact of the process. The use and disposal of acids or volatile or organic compounds, common and essential in most coating processes, pose a significant problem in the manufacturing community.

Therefore it is a primary object and feature of the present invention to provide a method and device for depositing a layer of material on a surface.

It is a further object and feature of the present invention to provide a device for depositing a layer of material on a surface which is simple and inexpensive to manufacture.

It is a further object and feature of the present invention to provide a device for depositing a layer of material on the surface which is inexpensive to operate and is recyclable.

It is a further object and feature of the present invention to provide a method of depositing a layer of material on the surface wherein the method requires no surface preparation.

It is a further object and feature of the present invention to provide a method for depositing a layer of material on the surface which requires no drying or curing for the material deposited thereon.

In accordance with the present invention, a device and method for depositing a layer of material on the surface is provided. The device includes a hub rotatable about an axis. A plurality of fibers project from the hub. The fibers are constructed from the material to be deposited on the surface. Means are provided for rotating the hub at a predetermined angular velocity such that a portion of the fibers engage the surface and melt. The melted material bonds to the surface without any preparation to the surface or the use of toxic materials.

It is contemplated that the device further includes a means for transporting the surface in a first direction along an axis perpendicular to the axis of rotation of the hub. It is further contemplated that the device including means for transporting the hub in a second, opposite direction along a second axis, generally parallel to the surface. Means are provided for varying the axial distance between the hub and the surface such that a generally constant length of each fiber will continually engage the surface.

The hub is generally cylindrical in shape and defines an outer peripheral surface. Each fiber projects from the outer peripheral surface of the hub and, may be integrally formed with the hub. In the preferred embodiment, the fiber is selected from the group of materials consisting of plastic compounds, metallics and ceramics.

In order to insure uniform melting, each fiber has a predetermined length and a predetermined diameter. It is contemplated that the length of each fiber will be generally equal, and the diameter of each fiber will be generally equal.

The method of the present invention includes providing a hub having a fiber constructed from the material to be deposited on the surface and moving the fiber across the surface such that a portion of the fiber engages the surface and melts thereon.

In a first embodiment, the step of moving the fiber across the surface includes the additional step of rotating the hub about a predetermined axis of rotation at a predetermined angular velocity. It is also contemplated to transport the hub along the axis parallel to the surface upon which the layer of material is to be deposited. As the fiber engages the surface and melts thereon, the axial distance between the hub and the surface is varied such that a generally constant length of the fiber engages the surface.

In an alternate embodiment, the method for depositing the layer of material on the surface includes interconnecting a fiber formed from the material to be deposited, onto a rotatable hub. The hub is spaced a predetermined distance from the surface. Thereafter, the hub is rotated about an axis of rotation such that a predetermined portion of fiber engages the surface and melts thereon.

It is contemplated that the method includes the further step of transporting the surface along the longitudinal axis perpendicular to the axis of rotation and varying the axial distance between the hub and the surface such that a constant length of fiber engages the surface. In the alternative, it is contemplated that the portion of the fiber engaging the surface may also be regulated by means of an external force acting on the spindle and transmitted to the fiber. It is further contemplated to transport the hub in a second, opposite direction to the movement of the surface along an axis parallel to the surface.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment. In the drawings:

FIG. 1 is a side elevational view of a material deposition tool in accordance with the present invention;

FIG. 2 is a side elevational view of the material deposition tool of FIG. 1 depositing a layer of material on a surface, shown in cross-section;

FIG. 3 is an enlarged, cross sectional view of the surface of FIG. 2.

FIG. 4 is a side elevational view showing the movement in phantom of the a material deposition tool in accordance with the present invention and the associated depositing of a layer of material on a surface, shown in cross section;

DESCRIPTION OF THE ILLUSTRATED EMBODIMENT

Figure 5:
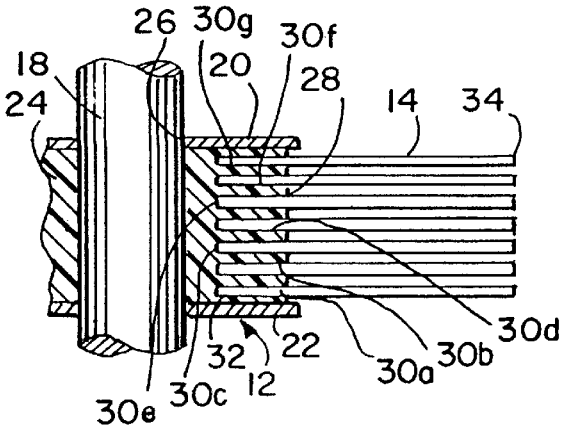
FIG. 5 is a cross sectional view of the material deposition tool of FIG. 1 taken along line 5—5.

Referring to FIG. 1, the material deposition tool of the present invention is generally designed by the reference numeral 10. Material deposition tool 10 includes a hub 12 and a plurality of fibers 14 projecting radially therefrom. In the preferred embodiment, the fibers 14 are generally equal in diameter and are generally equal in length.

Hub 12 includes a central aperture 16 therethrough having a predetermined diameter to accommodate a spindle 18. Spindle 18 is interconnected to and powered by a motor such that the motor spindle 18 in a conventional manner, as is known in the art.

Referring to FIG. 5, hub 12 includes a first and second circular generally flat plates 20 and 22, respectively. A generally cylindrical, resilient, fiber retaining core 24 is positioned between plates 20 and 22. Fiber retaining core 24 includes a first inner peripheral surface 26 which partially defines central aperture 16, and an outer peripheral surface 28. Outer peripheral surface 28 of fiber retaining core 24 includes a plurality of recesses 30*a*–*f* which extend from the outer periphery 28 toward the interior of fiber retaining core 24.

A first end 32 of each fiber 14 is positioned within a corresponding recess 30*a*–30*f* such that each second end 34 of each fiber 14 lie in a predetermined distance from the axis of rotation of hub 12. Thereafter, plates 20 and 22 are brought towards each other so as to compress fiber retaining core 24 thereby securing ends 32 of fibers 14 to fibers retaining core 24 and hence hub 12. Fastening elements 36 and 38 interconnect plates 20 and 22 so as to maintain fiber retaining cover 24 in a compressed state and retain fibers 14 to hub 12.

Figure 6:
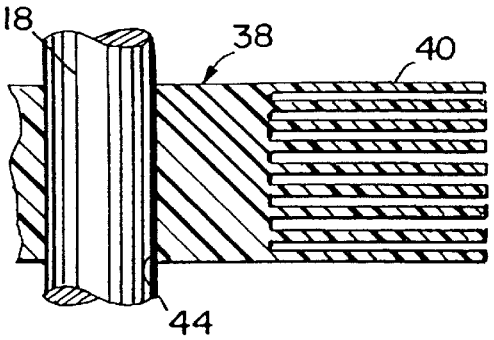
FIG. 6 is a cross sectional view, similar to FIG. 5, showing a material deposition tool of the present invention as a single, integral unit.

Referring to FIG. 6, in an alternate embodiment, a central hub 38 includes a plurality of fibers 40 projecting radially therefrom. Hub 38 and fibers 40 are integrally molded from the material to be deposited on surface 42. Hub 38 includes a central aperture 44 therein to accommodate spindle 18 therethrough.

Operation of material deposition tool 10 with hub 12 and with hub 38 is identical, and hence, operation of material deposition tool 10 with hub 12 will be described in detail with the description thereof being understood to describe the operation of material deposition tool 10 with hub 38.

Figure 7:
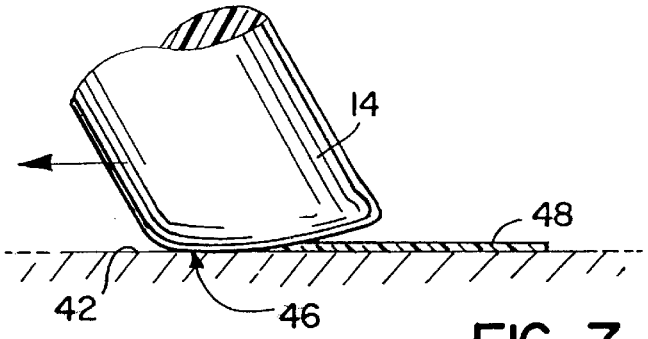
FIG. 7 is an enlarged side elevational view, showing a fiber depositing a layer of material on a surface shown in cross section.
Figure 8:
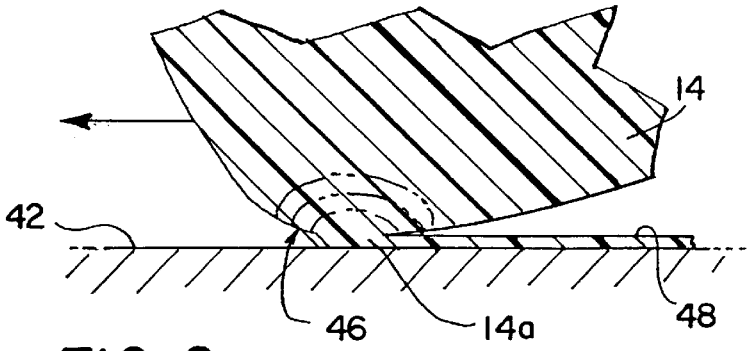
FIG. 8 is an enlarged cross sectional view, similar to FIG. 7, wherein the fiber is depositing a layer of material on a surface.

Referring to FIG. 2, in operation, spindle 18 and hence, hub 12 and fibers 14 extending therefrom, are rotated at a predetermined angular velocity. Spindle 18 is positioned a predetermined axial distance away from surface 42 such that the predetermined portion of the radially outer end 34 of fibers 14 will engage surface 42 at initial contact zone A. Impact and/or contact of fibers 14 with surface 42 leads to an abrupt temperature rise at the interface 46, FIGS. 7–8, thereof. The temperature rise at interface 46 leads to the melting of fiber 14 on surface 42.

It is contemplated that spindle 18 may be moved along a longitudinal axis in a first direction parallel to the surface 42 at a predetermined velocity and the surface 42 may be moved along a second, parallel longitudinal axis in a second, opposite direction. As the fibers contact 42 within contact zone A, FIG. 2, significant impact forces are developed at the interface of end 34 of fiber 14 and surface 42. Due to significant frictional forces at the ends 34 of each fiber 14, the temperature at the fiber interface 46, as previously described, abruptly increases. As the temperature increases, fiber 14 begins to melt at fiber interface 46. Molten material 14*a* is deposited and adheres to surface 42, when surface 42 cools. The described process results in the formation of a thin film 48 of fiber material adhering to surface 42.

As spindle 18 continues to rotate, the ends 34 engage the intermediate and final contact zones A' and A", respectively. However, it has been found that the temperature increase as described above is significantly greater within the initial contact region A versus the intermediate and final contact zones A' and A", respectively. As such, the movement of spindle 18 and of surface 42 maximizes the contact of the ends 34 of fibers 14 at initial contact zone A.

The thickness of film 48 is dependent upon numerous factors. These include the length of the portion of each end 34 of fibers 14 that engage surface 42, the angular velocity of each fiber 14 at its corresponding end 34, the length of each fiber 14, the radius of hub 42, the diameter of the fiber 14, the rate of movement of the spindle 18 along the first longitudinal axis, and the rate of movement of the surface 42 along the second longitudinal axis.

In order to insure that a generally constant length of each end 34 of fibers 14 engage surface 42, the axial distance between spindle 18 and surface 42 is varied. As best seen in FIG. 4, as spindle 18 moves from left to right, a predetermined portion of each fiber 14 melts and is deposited on surface 42. Consequently, spindle 18 moves toward surface 42 such that the axial distance d is correspondingly reduced in order to compensate for the melted portion of fiber 14 which has been deposited on surface 42. It is contemplated that the movement of spindle 18 be by manual means, or automated.

It is further contemplated as being within the scope of the present invention to maintain one of the spindle 18 or the surface 42 in a stationary position such that one of the spindle 18 or the surface 42 does not move horizontally along its corresponding longitudinal axis.

It is further contemplated that a means be provided for generating an external force on spindle 18 so as to transmit the same force to fiber 14. As a result, a generally constant force will be exerted by fiber 14 on surface 42 in order to insure the proper deposition of material on surface 42.

Various modes of carrying out the invention are contemplated as being within the scope of the following claims particularly pointing out and distinctly claiming the subject matter which is regarded as the invention.

I claim:

1. A method for depositing a layer of material on a surface, comprising the steps of:

providing a hub having a fiber constructed from the material to be deposited on the surface projecting therefrom; and engaging the surface with the fiber such that a portion of the fiber engages the surface with sufficient impact force that the portion melts and adheres to the surface to form the layer of material.

2. The method of claim 1 wherein the step of moving the fiber across the surface includes the additional step of rotating the hub about a predetermined axis of rotation.

3. The method of claim 1 comprising the additional step of rotating the hub at a predetermined angular velocity.

4. The method of claim 1 comprising the additional step of integrally molding the fiber and the hub.

5. The method of claim 1 wherein the step of moving the fiber across the surface includes the additional step of transporting the hub along a longitudinal axis parallel to the surface.

6. The method of claim 5 further comprising the addition of step of varying the axial distance between the hub and the surface such that a generally constant length of the fiber engages the surface.

7. The method of claim 1 further comprising the additional step of exerting a predetermined external force on the fiber to generate the impact force when the portion of the fiber engages the surface.

8. The method of claim 1 further comprising the additional step of transporting the surface along a predetermined longitudinal axis in a direction opposite to the movement of fiber across of the surfaces.

9. The method of claim 8 further comprising the additional step of varying the axial distance between the hub and the surface such that a generally constant length of the fiber engages the surface.

10. The method for depositing a layer of material on a surface, comprising the steps of:

interconnecting a fiber of the material to be deposited onto a rotatable hub, the hub spaced a predetermined distance from the surface; and rotating the hub about an axis of rotation such that a predetermined portion of the fiber engages the surface with an impact force sufficient to melt and adhere the predetermined portion of the fiber to the surface.

11. The method of claim 10 comprising the further step of transporting the surface along a longitudinal axis perpendicular to the axis of rotation of the hub.

12. The method of claim 11 comprising the additional step of varying the axial distance between the hub and the surface such that a generally constant length of the fiber engages the surface.

13. The method for depositing a layer of material on a surface, comprising the steps of:

interconnecting a fiber of the material to be deposited onto a rotatable hub, the hub spaced a predetermined distance from the surface; and rotating the hub about an axis of rotation such that a predetermined portion of the fiber engages the surface with an impact force sufficient to melt and adhere the predetermined portion of the fiber to the surface to form the layer of material.

14. The method of claim 10 comprising the further step of transporting hub along a longitudinal axis perpendicular to the axis of rotation of the hub and parallel to the surface.

15. The method of claim 14 comprising the additional step of varying the axial distance between the hub and the surface such that a generally constant length of the fiber engages the surface.

16. The method of claim 14 further comprising a means for exerting a predetermined external force on the fiber.

17. A method for depositing a layer of material on a surface, comprising the steps of:

rotating a hub about an axis spaced from the surface, the hub having a plurality of fibers projecting therefrom which terminate at corresponding outer ends formed from the material to be deposited on the surface;

engaging the surface with the outer ends of the fibers with a sufficient impact force such that a portion of the outer ends of each fiber melts and adheres to the surface to form the layer of material.

18. The method of claim 17 further comprising the step of varying the axial distance between the hub and the surface such that a generally constant length of each fiber engages the surface.

19. The method of claim 17 further comprising the step of integrally molding the hub and the fibers.

* * * * *